US010309267B2

(12) United States Patent
Tanaka et al.

(10) Patent No.: US 10,309,267 B2
(45) Date of Patent: Jun. 4, 2019

(54) VARIABLE VALVE MECHANISM, ENGINE, AND AUTOMATIC TWO-WHEELED VEHICLE

(71) Applicant: SUZUKI MOTOR CORPORATION, Hamamatsu-shi, Shizuoka (JP)

(72) Inventors: Koichi Tanaka, Hamamatsu (JP); Kunio Arase, Hamamatsu (JP); Koji Mori, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 97 days.

(21) Appl. No.: 15/639,762

(22) Filed: Jun. 30, 2017

(65) Prior Publication Data

US 2018/0010488 A1 Jan. 11, 2018

(30) Foreign Application Priority Data

Jul. 5, 2016 (JP) ..... 2016-133290

(51) Int. Cl.

| | |
|---|---|
| ***F01L 1/34*** | (2006.01) |
| ***F01L 1/344*** | (2006.01) |
| ***F01L 1/053*** | (2006.01) |
| ***F01L 1/18*** | (2006.01) |

(52) U.S. Cl.

CPC ..... *F01L 1/34409* (2013.01); *F01L 1/053* (2013.01); *F01L 1/18* (2013.01); *F01L 2001/0535* (2013.01)

(58) Field of Classification Search

CPC ..... F01L 1/053; F01L 1/34409; F01L 1/18; F01L 2001/0535

See application file for complete search history.

(56) References Cited

U.S. PATENT DOCUMENTS

2009/0308338 A1* 12/2009 Tashiro ..... F01L 1/047 123/90.6

FOREIGN PATENT DOCUMENTS

JP 2012-225277 A 11/2012

* cited by examiner

*Primary Examiner* — Zelalem Eshete
(74) *Attorney, Agent, or Firm* — Stein IP, LLC

(57) ABSTRACT

The present invention can achieve a variable valve mechanism having a simple and compact configuration. A variable valve mechanism changes an opening/closing timing of an intake valve or an exhaust valve in response to an engine rotation speed. The variable valve mechanism includes: a cam sprocket which rotates in response to a rotation of a crank shaft; an intake cam shaft which is integrated with an intake cam; an exhaust cam shaft which is integrated with an exhaust cam; and a governor flange that transmits a rotation of the cam sprocket to the intake cam shaft and the exhaust cam shaft. The intake cam shaft and the exhaust cam shaft are formed so that the other cam shaft is inserted through one cam shaft to be relatively rotatable. The governor flange is provided to rotate along with the intake cam shaft and rotates relative to the cam sprocket under a predetermined condition.

6 Claims, 12 Drawing Sheets

VARIABLE VALVE MECHANISM, ENGINE, AND AUTOMATIC TWO-WHEELED VEHICLE

INCORPORATION BY REFERENCE

This application is based upon and claims the benefit of priority from the corresponding Japanese Patent Application No. 2016-133290 filed on Jul. 5, 2016, the entire contents of which are incorporated herein by reference.

TECHNICAL FIELD

The present invention relates to a variable valve mechanism, an engine, and an automatic two-wheeled vehicle, and particularly, to a variable valve mechanism which can be applied to a single overhead camshaft (SOHC) type valve train, an engine, and an automatic two-wheeled vehicle.

BACKGROUND ART

Hitherto, as an engine of an automatic two-wheeled vehicle, there is known an engine including a variable valve mechanism changing operation characteristics (a valve opening/closing timing or a valve lift amount) of an intake valve and an exhaust valve in response to an engine rotation speed (for example, see JP 2012-225277 A). The variable valve mechanism described in JP 2012-225277 A is applied to a SOHC type valve train. Specifically, in JP 2012-225277 A, one cam shaft is provided with two kinds of cams (a low-speed cam and a high-speed cam) having different operation characteristics. Further, a rocker arm which drives an intake/exhaust valve is slidable in the axial direction of the cam shaft. When the rocker arm slides in response to an engine rotation speed, the low-speed cam and the high-speed cam can be switched. Thus, it is possible to obtain desired operation characteristics of the valve mechanism.

SUMMARY OF INVENTION

Technical Problem

However, JP 2012-225277 A has problems in that a configuration becomes complex due to diverse types of cams and an overall mechanism increases in size in the axial direction since a space for sliding the rocker arm needs to be ensured.

The invention has been made in view of the relevant points and an object of the invention is to provide a variable valve mechanism, an engine, and an automatic two-wheeled vehicle capable of realizing a simple and compact configuration.

Solution to Problem

An aspect of the present invention is summarized as a variable valve mechanism which changes an opening/closing timing of an intake valve or an exhaust valve in response to an engine rotation speed, the variable valve mechanism including: a cam sprocket which rotates in response to a rotation of a crank shaft; a first cam shaft which is integrated with any one of intake side and exhaust side cams; a second cam shaft which is integrated with the other cam; and a transfer member that transmits a rotation of the cam sprocket to the first and second cam shafts, wherein the first and second cam shafts are formed so that the other cam shaft is inserted through one cam shaft to be relatively rotatable; and the transfer member is provided to rotate along with any one of the first and second cam shafts and rotates relatively to the cam sprocket under a predetermined condition.

According to this configuration, since the transfer member rotates relatively to the cam sprocket under a predetermined condition, the first and second cam shafts rotate relatively through the transfer member. Accordingly, since a difference in rotation phase occurs between the intake side and exhaust side cams, the opening/closing timing of the intake valve or the exhaust valve can be changed without causing an increase in type of cam. In particular, since the other cam shaft is inserted through one cam shaft in the first and second cam shafts, the first and second cam shafts can be disposed to overlap each other in the axial direction. As a result, it is possible to prevent an increase in size in the axial direction of the overall variable valve mechanism. In this way, the variable valve mechanism can be realized with a simple and compact configuration.

In the above mentioned variable valve mechanism according to the present invention, the transfer member can rotate relatively to the cam sprocket when the engine rotation speed exceeds a predetermined rotation speed and rotates along with the cam sprocket when the engine rotation speed is a predetermined rotation speed or less. According to this configuration, since the transfer member is rotated relatively to or along with the cam sprocket in response to the engine rotation speed, the rotation phases of the first and second cam shafts can be changed. Thus, the valve timing can be appropriately adjusted in response to the engine state.

The above mentioned variable valve mechanism according to the present invention can further includes: an intermediate operation member that is able to switch a relative rotation or an integral rotation of the cam sprocket and the transfer member, wherein the intermediate operation member can engage with the cam sprocket and the transfer member and moves outward in the radial direction of the cam sprocket to rotate the transfer member relatively to the cam sprocket when the engine rotation speed exceeds a predetermined rotation speed. According to this configuration, since the intermediate operation member moves in response to the engine rotation speed, the transfer member can be rotated relatively to the cam sprocket. In this way, since the variable valve mechanism can be realized without using a separate actuator or the like, a configuration is simplified.

In the above mentioned variable valve mechanism according to the present invention, the intermediate operation member can include: a support portion which is supported by the cam sprocket to be rotatable; a weight portion which is formed to be separated from the support portion; and an engagement portion which engages with the transfer member; and the intermediate operation member can rotate about the support portion as a support point, when the weight portion moves outward in the radial direction in accordance with the rotation of the cam sprocket. According to this configuration, since the weight portion receives the centrifugal force accompanied by the rotation of the cam sprocket, the intermediate operation member rotates about the support portion as a support point. Accordingly, since the transfer member can be rotated relatively to the cam sprocket through the engagement portion, the valve timing can be adjusted with a simple and easy configuration.

In the above mentioned variable valve mechanism according to the present invention, the intermediate operation member can be formed to be slidable along a guide groove formed in the cam sprocket and the transfer member; and when the intermediate operation member moves outward in the radial direction in accordance with the rotation of the cam sprocket, the transfer member can rotate relatively to the cam sprocket. According to this configuration, the intermediate operation member moves outward in the radial direction along the guide groove due to the centrifugal force accompanied by the rotation of the cam sprocket. Accordingly, since the transfer member can be rotated relatively to the cam sprocket, the valve timing can be adjusted with a simple and easy configuration.

Further, the engine according to the invention may include the variable valve mechanism.

Further, the automatic two-wheeled vehicle according to the invention may include the engine.

According to the invention, since the intake side and exhaust side cam shafts are coaxially disposed to overlap each other, the variable valve mechanism can have a simple and compact configuration.

DESCRIPTION OF EMBODIMENTS

Figure 1:
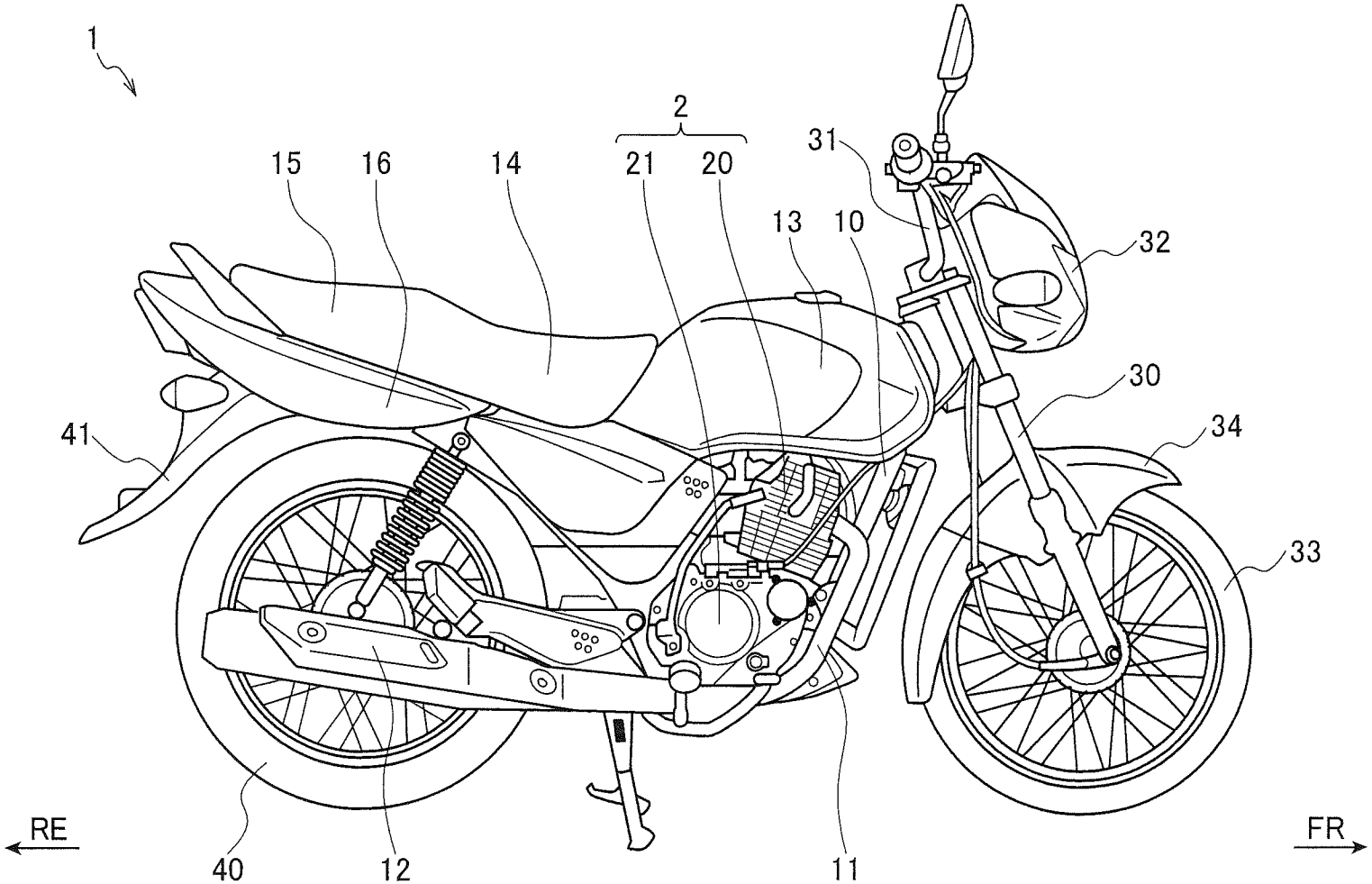
FIG. 1 is a side view illustrating a schematic configuration of an automatic two-wheeled vehicle including an engine that adopts a variable valve mechanism according to an embodiment.

Hereinafter, an embodiment of the invention will be described in detail with reference to the accompanying drawings. Further, in the following description, an example in which a variable valve mechanism according to the invention is applied to an engine of an automatic two-wheeled vehicle will be described, but the application target can be changed without limitation. For example, the variable valve mechanism according to the invention may be also applied to engines of other automatic two-wheeled vehicles, buggy type automatic three-wheeled vehicles, or automatic four-wheeled vehicles. Regarding the direction, the front side of the vehicle will be denoted by an arrow FR, and the rear side of the vehicle will be denoted by an arrow RE. Further, in the drawings below, a part of the configuration will be omitted for convenience of the description.

Referring to FIG. 1, a schematic configuration of an automatic two-wheeled vehicle that employs an engine according to the embodiment will be described. FIG. 1 is a side view illustrating a schematic configuration of an automatic two-wheeled vehicle including an engine that employs the variable valve mechanism according to the embodiment.

As illustrated in FIG. 1, an automatic two-wheeled vehicle 1 has a configuration in which an engine 2 is suspended on a vehicle body frame 10 formed of aluminum alloy or a steel product equipped with a power unit, an electricity system, and the like. The engine 2 is, for example, a single cylinder four-cycle engine. The engine 2 has a configuration in which a cylinder assembly 20 (hereinafter, simply referred to as a cylinder 20) obtained by a combination of a cylinder block or a cylinder head is attached to an upper portion of a crank casing 21.

Components such as a piston (not illustrated) or a valve train 5 (see FIG. 2) are received inside the cylinder 20. Although it will be described later in detail, the valve train 5 according to the embodiment is configured as a single overhead camshaft (SOHC) type valve train. Further, various shafts that transmit a rotation of a crank shaft (not illustrated) are received inside the crank casing 21 in addition to the crank shaft.

An exhaust pipe 11 is connected to a front exhaust port of the engine. The exhaust pipe 11 extends downward from the exhaust port, is bent under the crank casing 21, and extends toward the rear side of the vehicle body. A muffler 12 is attached to a rear end of the exhaust pipe 11. An exhaust gas which is produced after combustion is discharged to the outside through the exhaust pipe 11 and the muffler 12.

A fuel tank 13 is disposed at an upper portion of the vehicle body frame 10. A driver seat 14 and a passenger seat 15 are disposed at the rear side of the fuel tank 13 along with a rear cowl 16. A pair of left and right front forks 30 are supported by a front head portion of the vehicle body frame 10 to be steerable along with a handlebar 31. A head lamp 32 is provided at the front side of the handlebar 31. A front wheel 33 is supported by a lower portion of the front fork 30 to be steerable and an upper portion of the front wheel 33 is covered by a front fender 34.

A swing arm (not illustrated) is connected to a rear portion of the vehicle body frame 10 to be swingable up and down. A rear wheel 40 is supported by the rear portion of the swing arm to be rotatable. A driven sprocket (not illustrated) is provided at the left side of the rear wheel 40 and power of the engine 2 is transmitted to the rear wheel 40 by a drive chain (not illustrated). An upper portion of the rear wheel 40 is covered by a rear fender 41 provided at a rear portion of the rear cowl 16.

Figure 2:
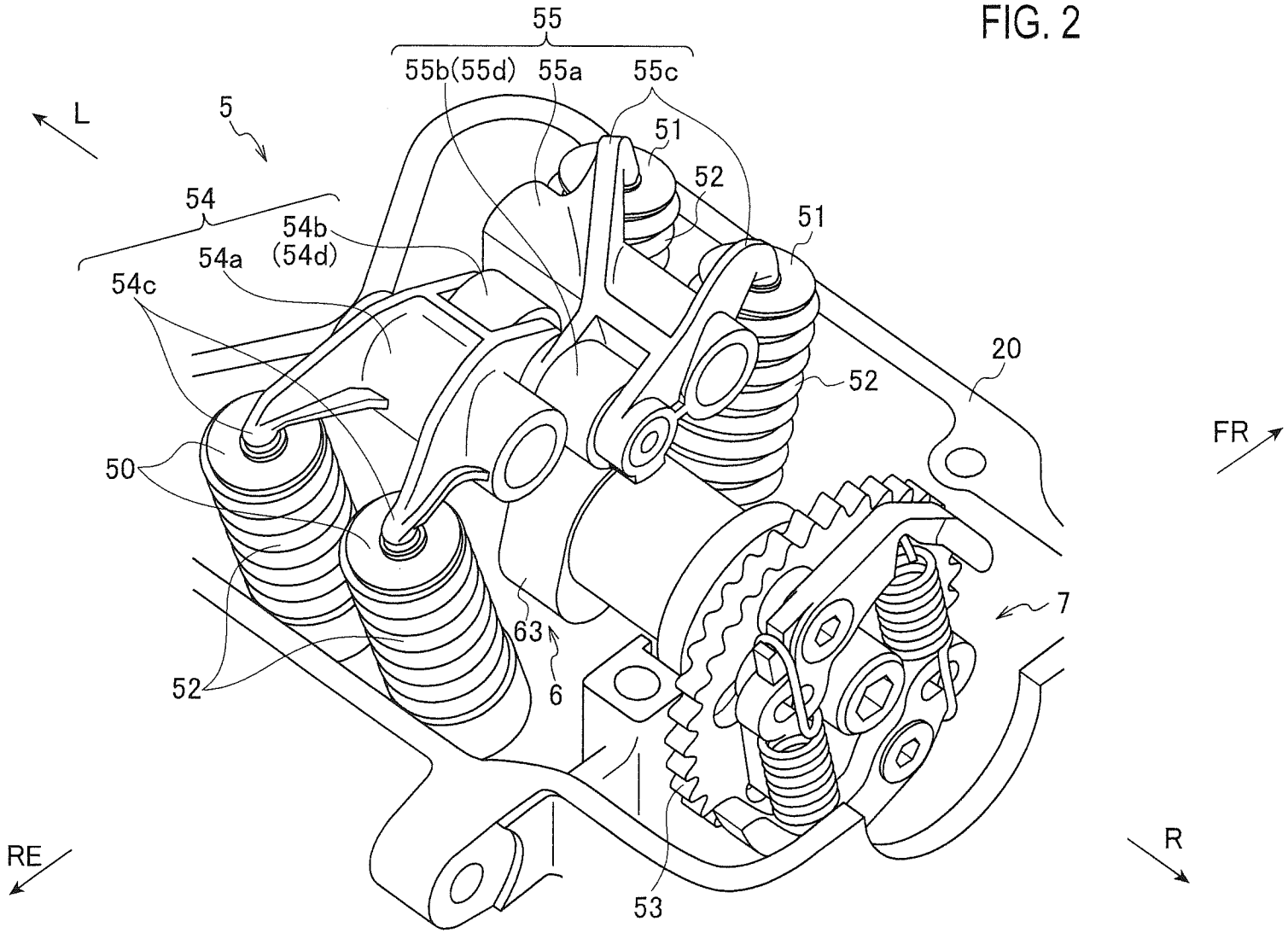
FIG. 2 is a perspective view of a valve train according to the embodiment.

Next, the valve train according to the embodiment will be described with reference to FIG. 2. FIG. 2 is a diagram illustrating a state where a cylinder head cover is separated from the engine and is a perspective view of the valve train according to the embodiment.

As illustrated in FIG. 2, the valve train 5 which controls the opening/closing of an intake valve 50 and an exhaust valve 51 is provided at an upper portion of the cylinder 20. As described above, the valve train 5 is an SOHC type valve train and has a configuration in which a cam shaft assembly 6 (hereinafter, simply referred to as a cam shaft 6) is disposed above the intake valve 50 and the exhaust valve 51.

Two intake valves 50 are disposed at the cam shaft 6 on the rear side of the vehicle to be arranged in the left and right direction (the vehicle width direction). Further, two exhaust valves 51 are disposed at the cam shaft 6 on the front side of the vehicle to be arranged in the left and right direction. Each of the intake valves 50 and the exhaust valves 51 is provided with a valve spring 52. The intake valves 50 and the exhaust valves 51 are constantly urged upward (in a closing direction) by the valve springs 52.

Figure 3:
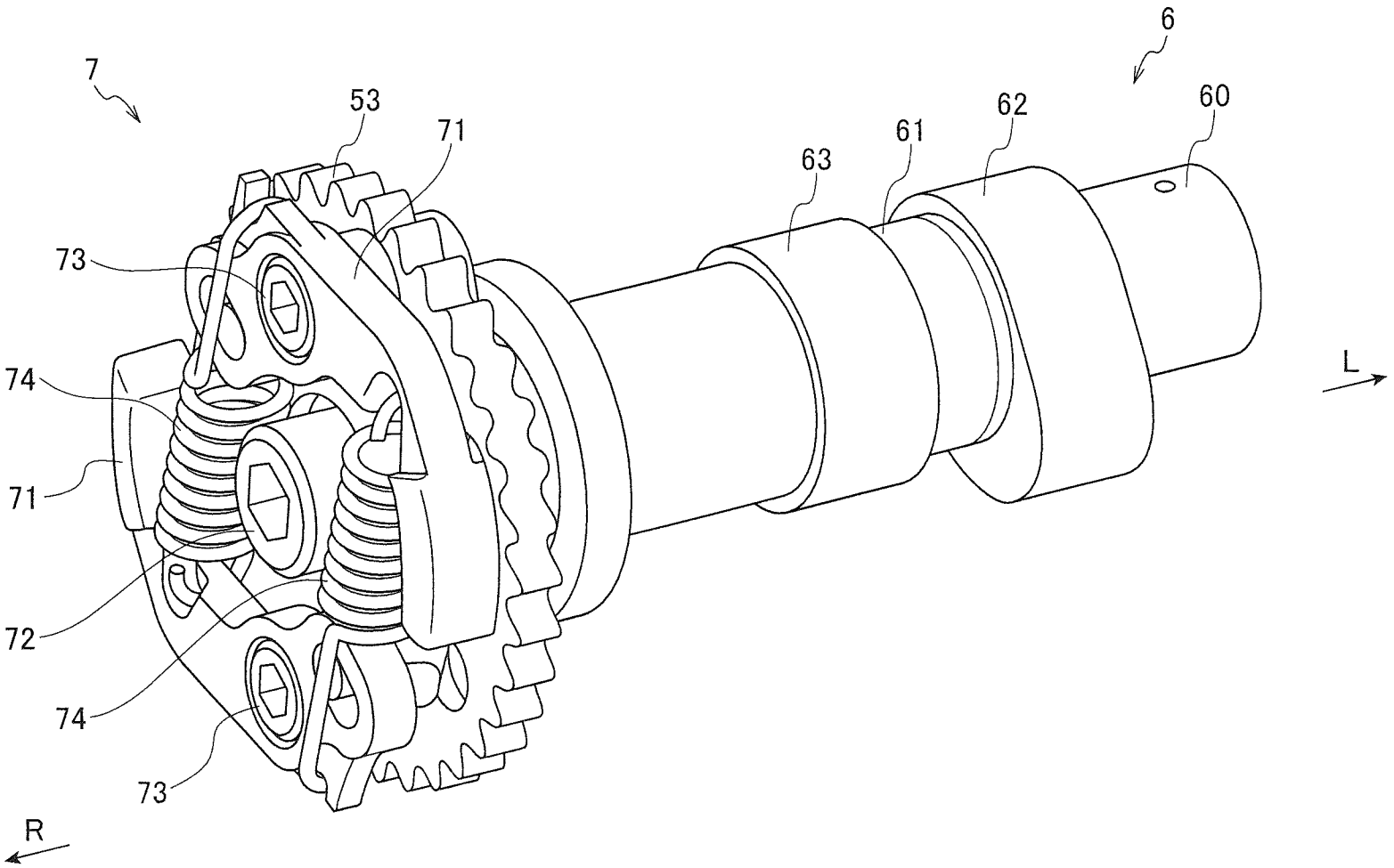
FIG. 3 is a perspective view illustrating the variable valve mechanism according to the embodiment.

The cam shaft 6 extends in the left and right direction. An intake cam 62 and an exhaust cam 63 are provided at the cam shaft 6 to be arranged in the left and right direction. Specifically, as illustrated in FIGS. 2 and 3, the left side in the axial direction is the intake cam 62 and the right side in the axial direction is the exhaust cam 63. Further, a right end of the cam shaft 6 is provided with a cam sprocket 53. A cam chain (not illustrated) which transmits the rotation of the crank shaft is wound around the cam sprocket 53.

Figure 4:
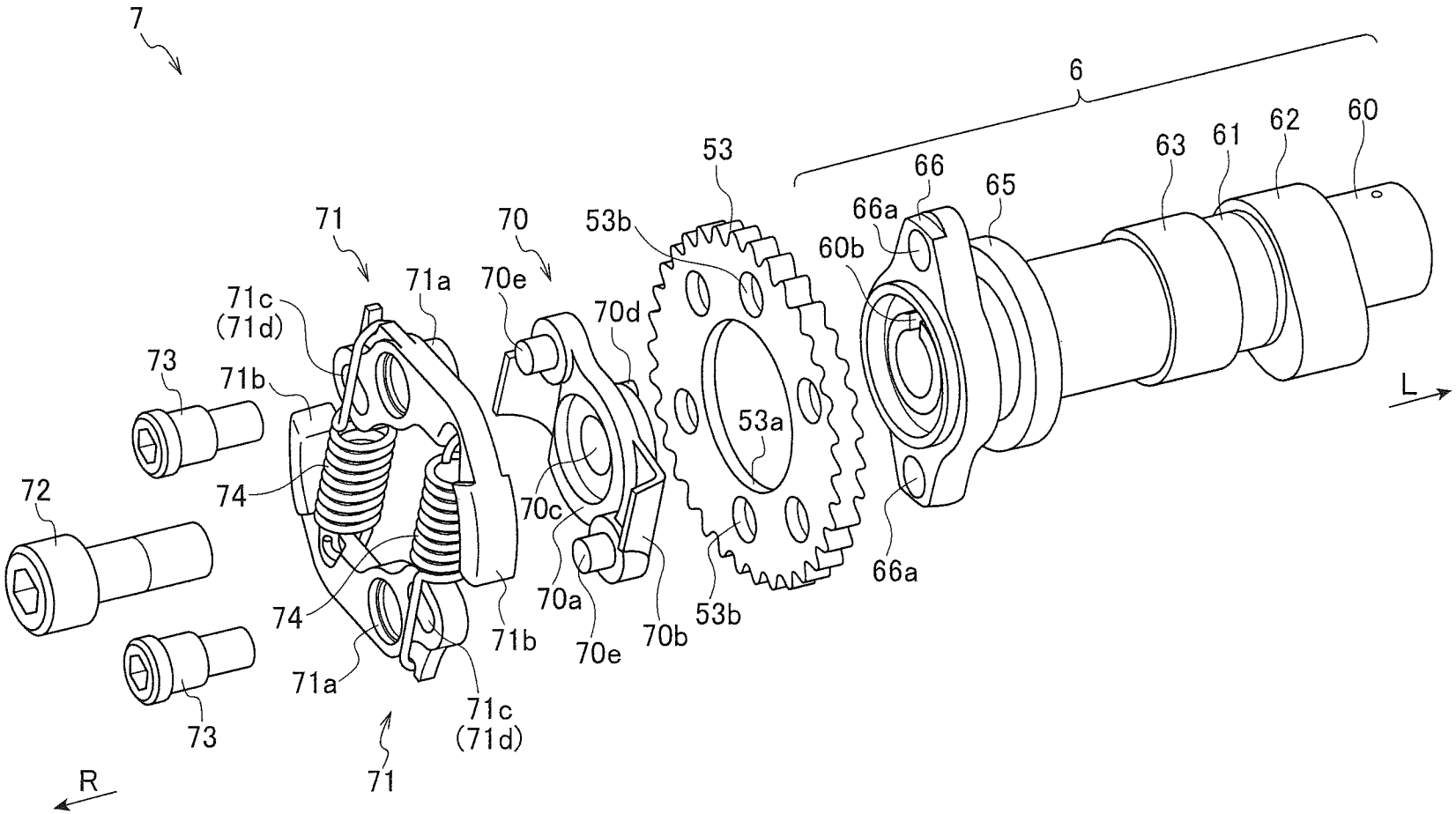
FIG. 4 is an exploded perspective view of the variable valve mechanism illustrated in FIG. 3.

The cam shaft 6 is obtained by coaxially assembling an intake cam shaft 60 (a first cam shaft) and an exhaust cam shaft 61 (a second cam shaft) (see FIG. 4). Although it will be described later in detail, the cam shaft 6 and the peripheral components constitute a variable valve mechanism 7 which changes the opening/closing timings of the intake valve 50 and the exhaust valve 51.

An intake rocker arm 54 which opens and closes the intake valve 50 and an exhaust rocker arm 55 which opens and closes the exhaust valve 51 are provided above the cam shaft 6 (the intake cam 62 and the exhaust cam 63). The intake rocker arm 54 is supported to be swingable by an intake rocker shaft (not illustrated) extending in the left and right direction. Specifically, the intake rocker arm 54 includes a support portion 54*a* which serves as a swing support point, a contact portion 54*b* which contacts the intake cam 62, and a pressing portion 54*c* which presses the intake valve 50.

The support portion 54*a* has a cylindrical shape through which the intake rocker shaft is insertable. The contact portion 54*b* extends forward and downward from the support portion 54*a* and a roller 54*d* is attached to a front end thereof. An outer surface of the roller 54*d* is in contact with an outer surface of the intake cam 62. The pressing portion 54*c* is bifurcated backward and downward from the support portion 54*a* and front ends thereof are in contact with an upper end of the intake valve 50.

The exhaust rocker arm 55 is also supported to be swingable by an exhaust rocker shaft (not illustrated) extending in the left and right direction. Specifically, the exhaust rocker arm 55 includes a support portion 55*a* which serves as a swing support point, a contact portion 55*b* which contacts the exhaust cam 63, and a pressing portion 55*c* which presses the exhaust valve 51.

The support portion 55*a* has a cylindrical shape through which the exhaust rocker shaft is insertable. The contact portion 55*b* extends backward and downward from the support portion 55*a* and a roller 55*d* is attached to a front end thereof. An outer surface of the roller 55*d* is in contact with an outer surface of the exhaust cam 63. The pressing portion 55*c* is bifurcated forward and downward from the support portion 55*a* and front ends thereof are in contact with an upper end of the exhaust valve 51.

In the valve train 5 with such a configuration, when the cam shaft 6 rotates along with the rotation of the crank shaft, the contact portion 54*b* (the contact portion 55*b*) slides along a cam surface (the outer surface) of the intake cam 62 (the exhaust cam 63). Especially, the contact portion 54*b* (the contact portion 55*b*) is pressed upward by a protruding portion of the intake cam 62 (the exhaust cam 63). For this reason, the intake rocker arm 54 (the exhaust rocker arm 55) rotates about the support portion 54*a* (the support portion 55*a*) as a support point and the pressing portion 54*c* (the pressing portion 55*c*) moves downward.

At this time, the pressing portion 54*c* (the pressing portion 55*c*) presses the intake valve 50 (the exhaust valve 51) downward (in an opening direction) against an urging force of the valve spring 52. As a result, the intake valve 50 (the exhaust valve 51) is opened. When the contact portion 54*b* (the contact portion 55*b*) gets over the protruding portion of the intake cam 62 (the exhaust cam 63), the intake valve 50 (the exhaust valve 51) is urged upward by the urging force of the valve spring 52. As a result, the intake valve 50 (the exhaust valve 51) is closed. In this way, the opening and closing of the intake valve 50 and the exhaust valve 51 is controlled.

Incidentally, as a valve train, there is known a valve train including a variable valve mechanism that changes operation characteristics (including a valve timing or a valve lift amount) of the intake valve and the exhaust valve in response to the engine rotation speed. For example, in the variable valve mechanism applied to the SOHC type valve train, one cam shaft is provided with two kinds of cams (a low-speed cam and a high-speed cam) having different operation characteristics. Further, the rocker arm for driving the intake/exhaust valve is slidable in the axial direction of the cam shaft.

In this case, since the number of types of cams increases in order to change the operation characteristics, a complex configuration is obtained. Alternatively, since a structure for sliding the rocker arm or a slide space is required, a problem arises in that the overall mechanism increases in size in the axial direction of the cam shaft in addition to the complex configuration.

Here, in the embodiment, the intake cam shaft 60 is formed to be inserted through the exhaust cam shaft 61 (see FIG. 5) and the intake cam shaft 60 and the exhaust cam shaft 61 are disposed to overlap each other in the axial direction. Accordingly, an increase in length of the cam shaft 6 in the axial direction is prevented. Further, since the intake cam shaft 60 and the exhaust cam shaft 61 are rotated relatively to each other in response to the engine rotation speed, the rotation phase of the intake cam shaft 60 can be displaced. Accordingly, it is possible to realize the variable valve mechanism 7 capable of changing the operation characteristics (including a rotation phase) of the intake cam 62 (see FIG. 5) by a simple and compact configuration without a particular cam having different operation characteristics.

Figure 5:
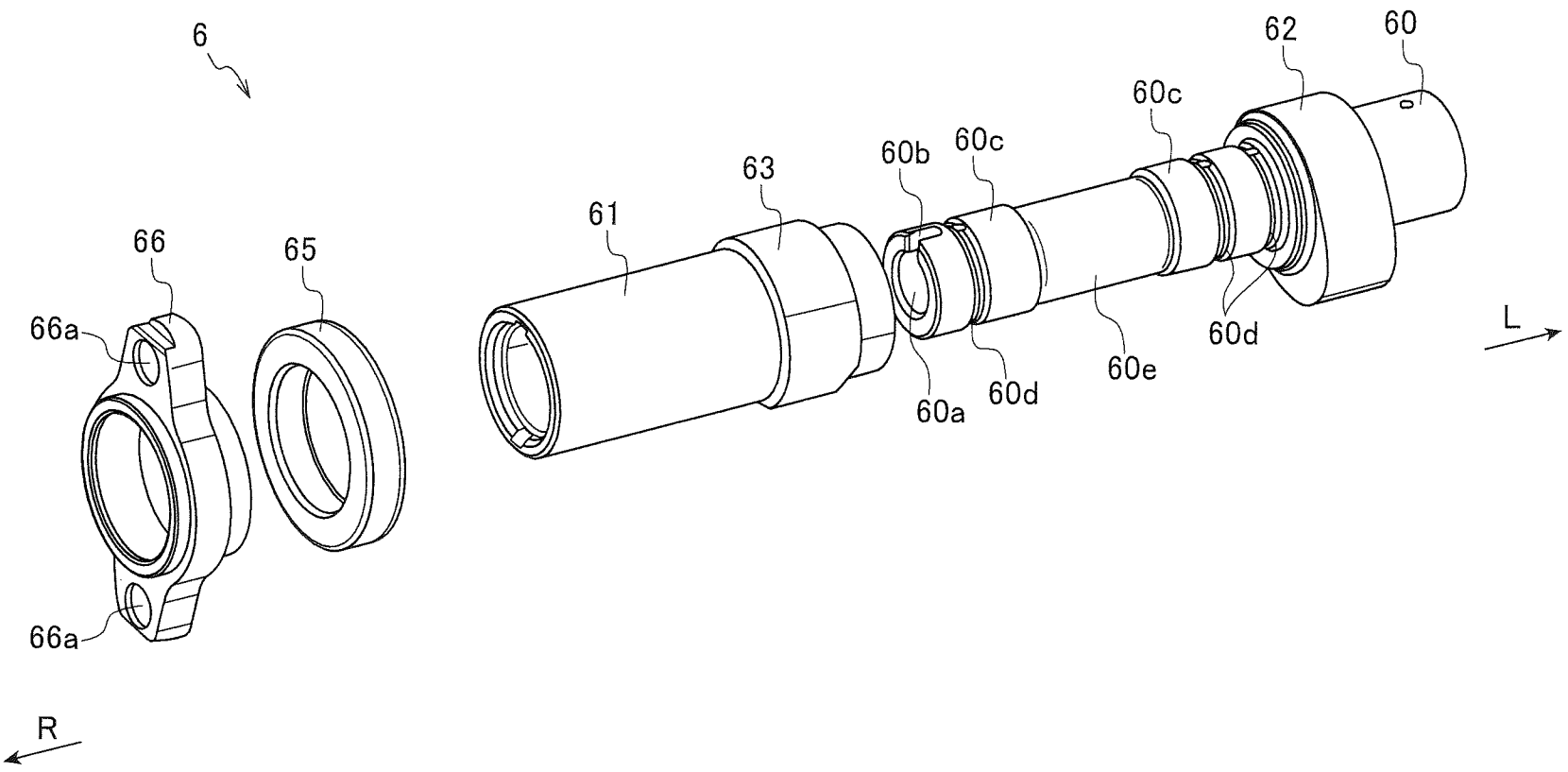
FIG. 5 is an exploded perspective view of a cam shaft assembly (cam shaft) according to the embodiment.
Figure 6:
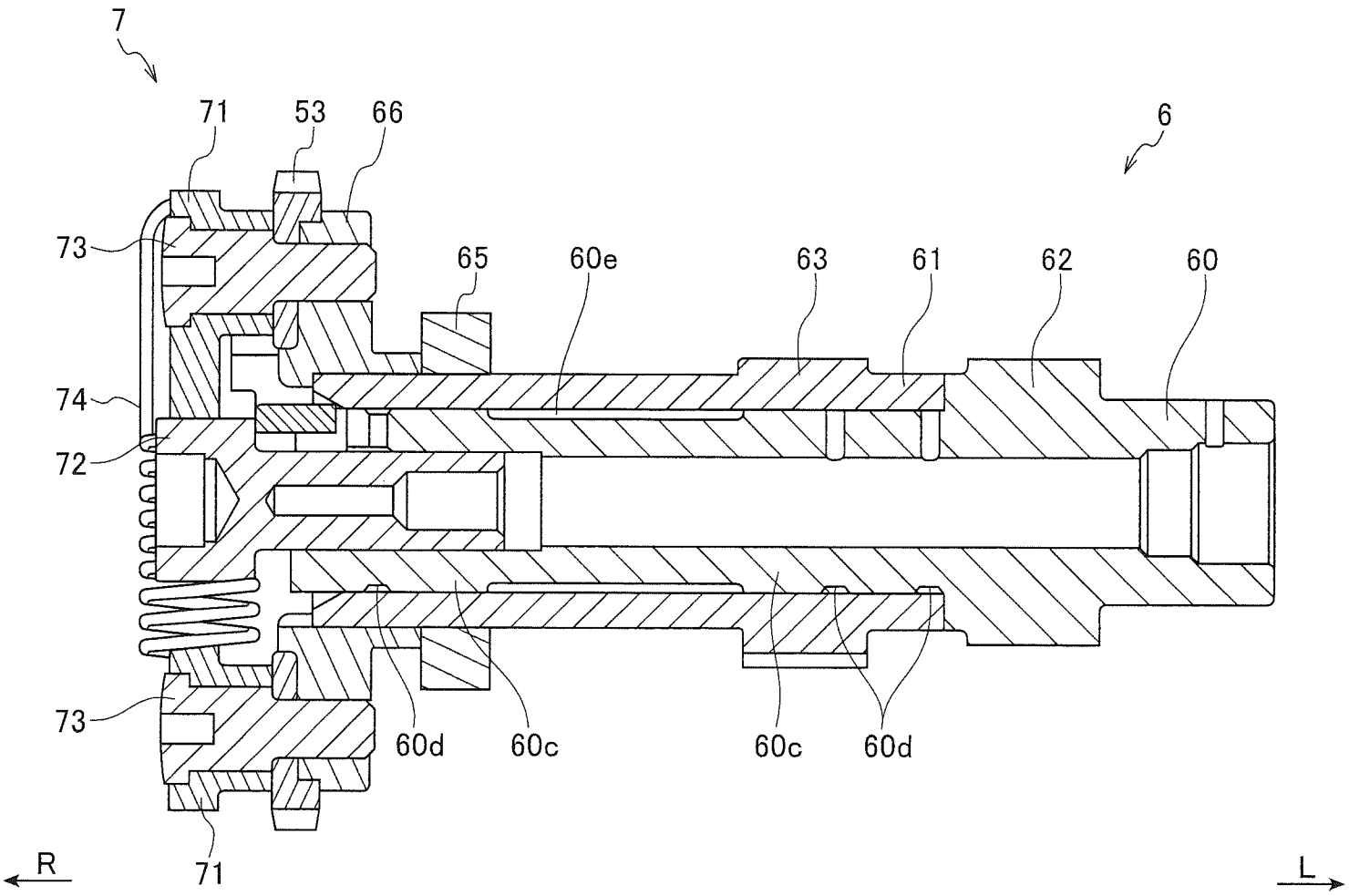
FIG. 6 is a cross-sectional view of the variable valve mechanism illustrated in FIG. 3.

Next, the variable valve mechanism according to the embodiment will be described with reference to FIGS. 3 to 6. FIG. 3 is a perspective view illustrating a part of the variable valve mechanism according to the embodiment. FIG. 4 is an exploded perspective view of the variable valve mechanism illustrated in FIG. 3. FIG. 5 is an exploded perspective view of the cam shaft assembly (the cam shaft) according to the embodiment. FIG. 6 is a cross-sectional view of the variable valve mechanism illustrated in FIG. 3.

As described above, the valve train 5 according to the embodiment (see FIG. 2) includes the variable valve mechanism 7 which changes the opening and closing timing of the intake valve 50 or the exhaust valve 51 (see FIG. 2) in response to an engine rotation speed. Specifically, as illustrated in FIG. 3, the variable valve mechanism 7 is a so-called governor type variable valve timing mechanism which advances the valve timing of the intake valve 50 by using the centrifugal force generated by the rotation of the cam shaft 6 (the cam sprocket 53).

As illustrated in FIGS. 3 and 4, the variable valve mechanism 7 has a configuration in which a governor flange 70 or a pair of governor arms 71 are attached to a right surface of the cam sprocket 53 provided at the right end of the cam shaft 6 through bolts 72 and 73. Although it will be described later in detail, the governor arm 71 can be rotated by the centrifugal force generated by the rotation of the cam shaft 6.

A circular hole 53*a* is formed at the center of the cam sprocket 53. Further, a side surface of the cam sprocket 53 is provided with two penetration holes 53*b* which serve as rotation support points of the governor arms 71. Two penetration holes 53*b* are formed at the opposite positions with the circular hole 53*a* interposed therebetween. The cam sprocket 53 is attached to the exhaust cam shaft 61 to be rotatable together through a sprocket flange 66 to be described later.

The governor flange 70 includes a circular portion 70*a* which engages with the intake cam shaft 60 to be described later and a flange portion 70*b* which is widened outward in the radial direction from the outer periphery of the circular portion 70*a*. A circular hole 70*c* is formed at the center of the circular portion 70*a*. When the bolt 72 passes through the circular hole 70*c* and the bolt 72 is threaded into the intake cam shaft 60, the governor flange 70 is fixed to the intake cam shaft 60.

An engagement pin 70*d* is attached to the circular portion 70*a* to be located at a position separated from the center in the radial direction. The engagement pin 70*d* protrudes toward the cam shaft 6. When the engagement pin 70*d* engages with the engagement groove 60*b* of the intake cam shaft 60, the governor flange 70 and the intake cam shaft 60 rotate together. The flange portion 70*b* is provided with two engagement pins 70*e* which protrude outward (rightward) in the axial direction. Each engagement pin 70*e* engages with an engagement hole 71*d* of the governor arm 71. The governor flange 70 with this configuration serves as a transfer member that transmits the rotation of the cam sprocket 53 to the intake cam shaft 60.

The governor arm 71 is formed in a substantially crescent shape to follow the circumferential direction of the cam sprocket 53. Specifically, the governor arm 71 includes a support portion 71*a* which is supported by the cam sprocket 53 to be rotatable, a weight portion 71*b* which is formed to be separated from the support portion 71*a*, and an engagement portion 71*c* which engages with the governor flange 70 (the engagement pin 70*e*).

The support portion 71*a* has a cylindrical shape through which the bolt 73 is insertable. The governor arm 71 extends from the support portion 71*a* toward the front side in the rotation direction and a front end thereof is slightly bent inward in the radial direction. The bent front end portion is formed as the weight portion 71*b*. Further, the engagement portion 71*c* slightly extends from the support portion 71*a* toward the rear side in the rotation direction and a rear end thereof is slightly located at the inside in the radial direction in relation to the support portion 71*a*. The rear end portion of the engagement portion 71*c* is provided with the engagement hole 71*d* which can engage with the engagement pin 70*e*. The engagement hole 71*d* is formed in a substantially S-shape to be long in the radial direction.

The pair of governor arms 71 are attached to the cam sprocket 53 to be rotatable when the bolt 73 is inserted through the penetration hole 53*b* of the cam sprocket 53 and the support portion 71*a* and the bolt 73 is threaded into the sprocket flange 66 while the engagement pin 70*e* of the governor flange 70 engages with the engagement hole 71*d*. Although it will be described later in detail, the governor arm 71 serves as an intermediate operation member capable of switching the relative rotation or the integral rotation between the cam sprocket 53 and the governor flange 70.

Further, the pair of governor arms 71 are provided with a pair of governor springs 74 which urge the weight portions 71*b* inward in the radial direction. The governor spring 74 is formed as, for example, a compression coil spring. One end of the governor spring 74 engages with a base end (a front bent portion of the governor arm 71) of the weight portion 71*b* of any one governor arm 71. Further, the other end of the governor spring 74 engages with a rear end portion (between the support portion 71*a* and the engagement portion 71*c*) of the facing other governor arm 71.

Next, a detailed configuration of the cam shaft 6 will be described. As illustrated in FIG. 5, the cam shaft 6 has a configuration in which a sprocket flange 66 is attached to a right end of the exhaust cam shaft 61 through the cylindrical exhaust cam shaft 61 and the bearing 65 of the intake cam shaft 60.

The intake cam shaft 60 is formed in a hollow shape and extends in the left and right direction. The intake cam 62 is integrally formed at the left end of the intake cam shaft 60. A screw hole 60*a* for a bolt 72 (see FIG. 4) is provided at the right end of the intake cam shaft 60. Further, an engagement groove 60*b* which engages with an engagement pin 70*d* of the governor flange 70 is formed at the outer peripheral side of the right end of the intake cam shaft 60.

Further, a portion which is located on the right side of the intake cam 62 in the intake cam shaft 60 and is received inside the exhaust cam shaft 61 is formed so that a base end and a right end are larger (thicker) than an intermediate portion 60*e* in the radial direction. The thick portion of the intake cam shaft 60 serves as a support portion 60*c* which supports the exhaust cam shaft 61. Specifically, an outer diameter of the support portion 60*c* is substantially equal to an inner diameter of the exhaust cam shaft 61. Further, an outer surface of the support portion 60*c* is provided with an annular groove 60*d*. The annular groove 60*d* and the intermediate portion 60*e* serve as an oil supply path which supplies oil to a sliding surface between the intake cam shaft 60 and the exhaust cam shaft 61.

The exhaust cam shaft 61 is formed such that the exhaust cam 63 is integrally formed at a left end, that is, an end opposite to the sprocket flange 66 and has a cylindrical shape through which the intake cam shaft 60 is insertable. Specifically, an inner diameter of the exhaust cam shaft 61 is set to be slightly larger than an outer diameter of the intake cam shaft 60. A length of the exhaust cam shaft 61 is substantially the same as a length of the intake cam shaft 60 on the right side of the intake cam 62. Further, the exhaust cam shaft 61 and the intake cam shaft 60 are formed to be rotatable relatively to each other.

The sprocket flange 66 which is provided at the right end of the exhaust cam shaft 61 is provided with two screw holes 66*a* which correspond to the penetration holes 53*b* of the cam sprocket 53. The sprocket flange 66 is attached to the exhaust cam shaft 61 to be rotatable together and the cam sprocket 53 is fixed thereto.

Figure 7A:
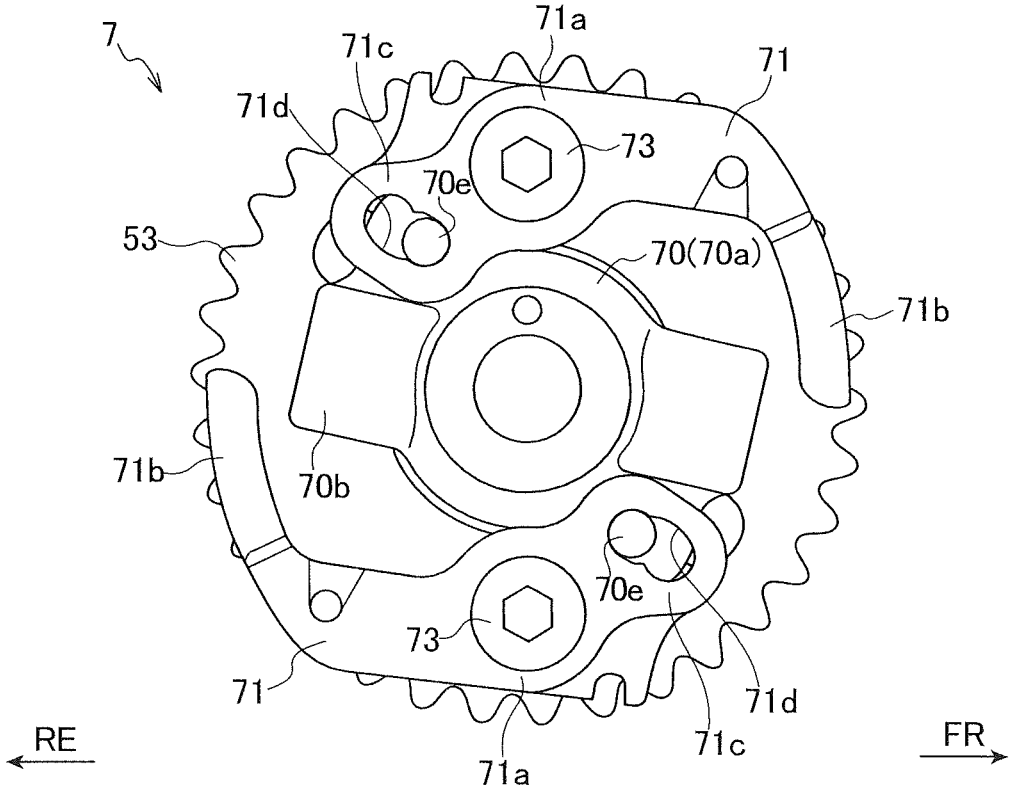
FIGS. 7A and 7B are diagrams illustrating an operation of the variable valve mechanism according to the embodiment.
Figure 7B:
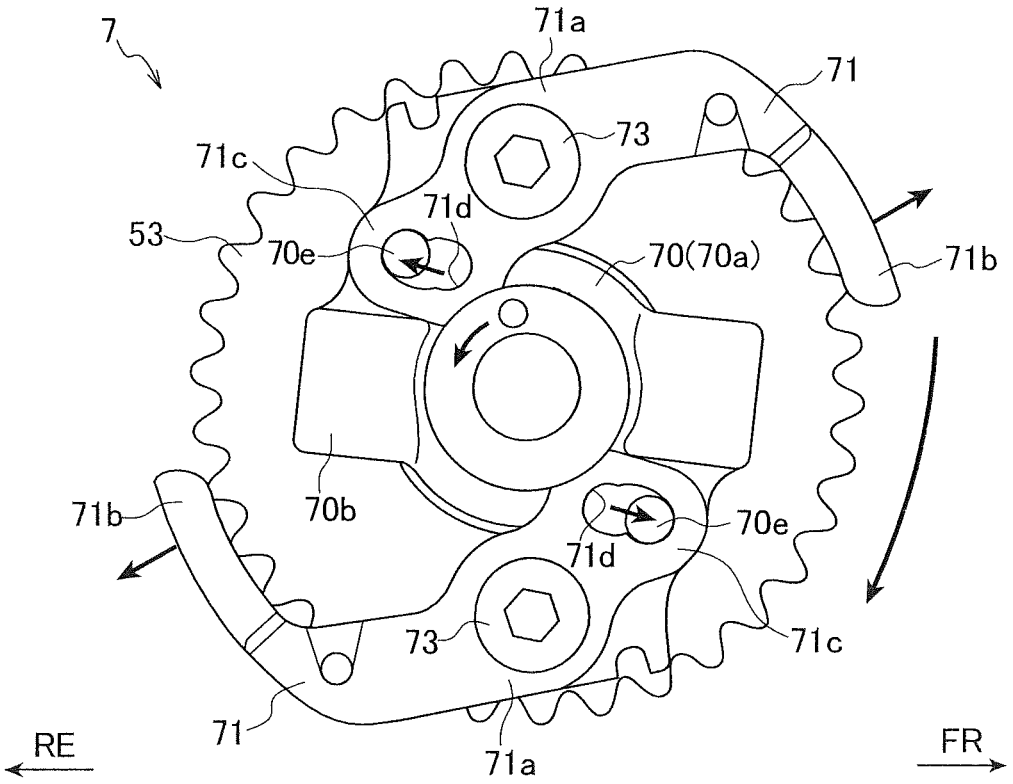

Next, an operation of the variable valve mechanism according to the embodiment will be described with reference to FIGS. 7A and 7B. FIGS. 7A and 7B are diagrams illustrating an operation of the variable valve mechanism according to the embodiment. FIG. 7A illustrates a state where the governor arm is closed and FIG. 7B illustrates a state where the governor arm is opened. Additionally, the governor spring or a part of configurations are not illustrated in FIGS. 7A and 7B for convenience of the description.

In the variable valve mechanism 7, as illustrated in FIGS. 7A and 7B, the governor arm 71 is urged inward in the radial direction of the cam sprocket 53 by the governor spring 74 (not illustrated). For example, when an engine rotation speed is a predetermined rotation speed or less, a centrifugal force generated in the weight portion 71*b* is smaller than an urging force of the governor spring 74 as illustrated in FIG. 7A. For this reason, the governor arm 71 does not rotate about the support portion 71*a* as a support point.

Further, the weight portion 71*b* is located at a closed position which does not protrude outward in the radial direction from the outer edge of the cam sprocket 53. At this time, the engagement pin 70*e* of the governor flange 70 contacts the inner end of the engagement hole 71*d* in the radial direction. In this case, the governor flange 70 and the cam sprocket 53 rotate together without any relative rotation. Accordingly, the intake cam shaft 60 and the exhaust cam shaft 61 (see FIG. 5) which engage with the governor flange 70 also rotate together with the cam sprocket 53. As a result, in the valve train 5 (see FIG. 2), the opening and closing of the intake valve 50 and the exhaust valve 51 is controlled at a normal valve timing.

Meanwhile, when the engine rotation speed exceeds a predetermined rotation speed, a centrifugal force generated in the weight portion 71*b* becomes larger than an urging force of the governor spring 74. For this reason, as illustrated in FIG. 7B, the governor arm 71 rotates about the support portion 71*a* as a support point and the weight portion 71*b* moves outward in the radial direction. Accordingly, the weight portion 71*b* is located at an opened position which protrudes outward in the radial direction from the outer edge of the cam sprocket 53.

Further, the engagement portion 71*c* moves inward in the radial direction by the rotation of the governor arm 71. Accordingly, the governor flange 70 rotates in a direction opposite to the cam sprocket 53 while the engagement pin 70*e* contacts the outer end of the engagement hole 71*d* in the radial direction. As a result, the opening/closing timing of the intake valve 50 is adjusted. In this way, when the governor arm 71 is rotated so that the governor flange 70 and the cam sprocket 53 rotate relatively in response to the engine rotation speed in the variable valve mechanism 7, the opening/closing timing of the intake valve 50 can be changed.

In this way, in the variable valve mechanism 7 according to the embodiment, the intake cam shaft 60 and the exhaust cam shaft 61 rotate relatively to each other through the governor flange 70 when the governor flange 70 rotates relatively to the cam sprocket 53 under a predetermined condition. Accordingly, since a difference in rotation phase occurs in the intake cam 62, it is possible to change the opening/closing timing of the intake valve 50 without increasing the number of types of cams. Particularly, when the intake cam shaft 60 is inserted through the exhaust cam shaft 61, the intake cam shaft 60 and the exhaust cam shaft 61 can be disposed to overlap each other in the axial direction. As a result, it is possible to prevent an increase in size of the overall variable valve mechanism 7 in the axial direction. In this way, the variable valve mechanism 7 can be realized with a simple and compact configuration.

Further, the governor flange 70 rotates relatively to the cam sprocket 53 when the engine rotation speed exceeds a predetermined rotation speed and rotates along with the cam sprocket 53 when the engine rotation speed is a predetermined rotation speed or less. In this way, when the governor flange 70 is rotated relatively to or along with the cam sprocket 53 in response to the engine rotation speed, the rotation phase of the intake cam shaft 60 can be changed. Thus, the valve timing can be appropriately adjusted in response to the engine state.

Further, when the governor arm 71 moves in response to the engine rotation speed in the variable valve mechanism 7, the governor flange 70 can be rotated relatively to the cam sprocket 53. Thus, since the variable valve mechanism 7 can be realized without a particular actuator or the like, a configuration is simplified. Further, since the weight portion 71*b* receives a centrifugal force accompanied by the rotation of the cam sprocket 53, the governor arm 71 rotates about the support portion 71*a* as a support point. Accordingly, since the governor flange 70 can be rotated relatively to the cam sprocket 53 through the engagement portion 71*c*, the valve timing can be adjusted with a simple and easy configuration.

Figure 8:
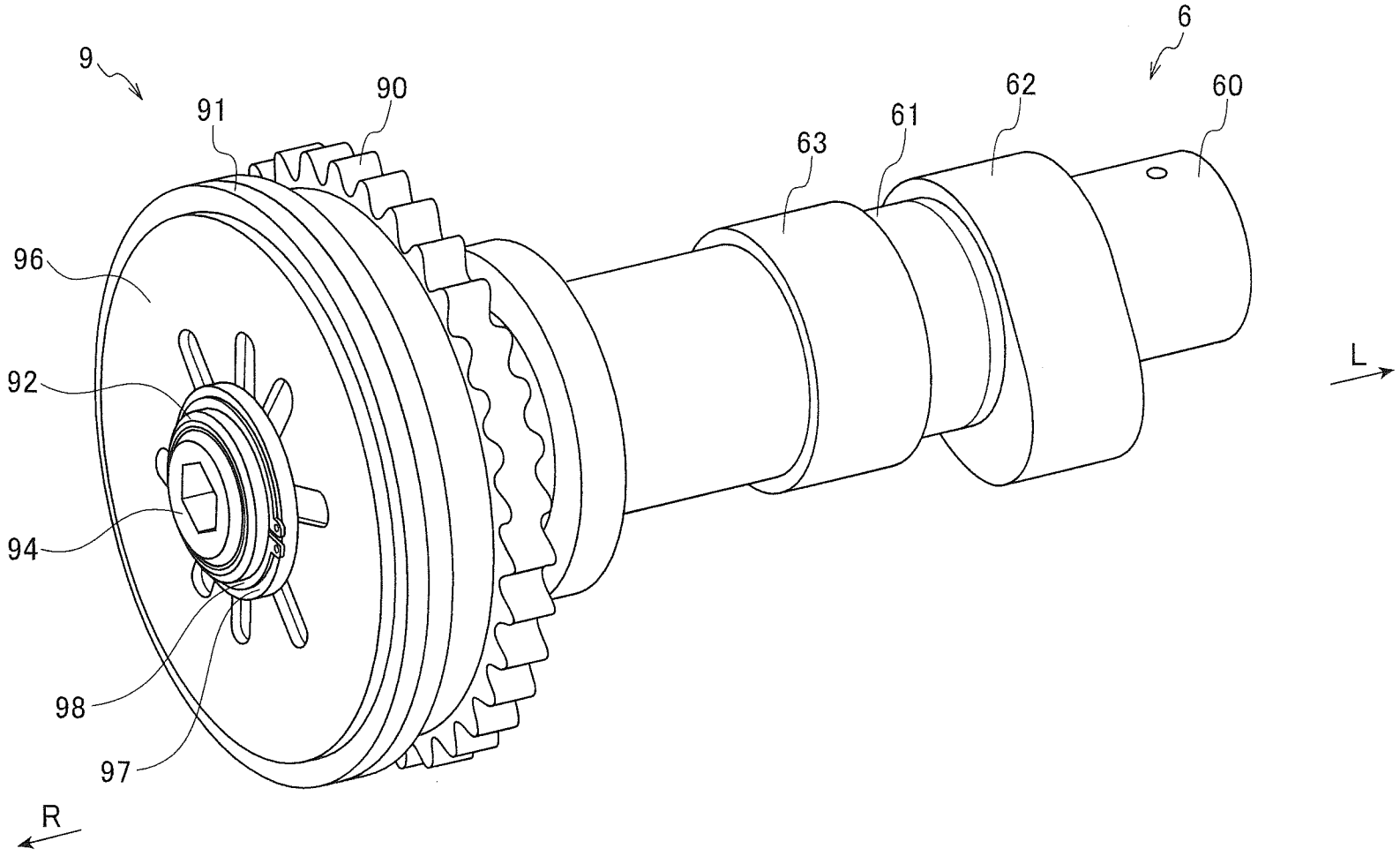
FIG. 8 is a perspective view illustrating a variable valve mechanism according to a modified example.
Figure 9:
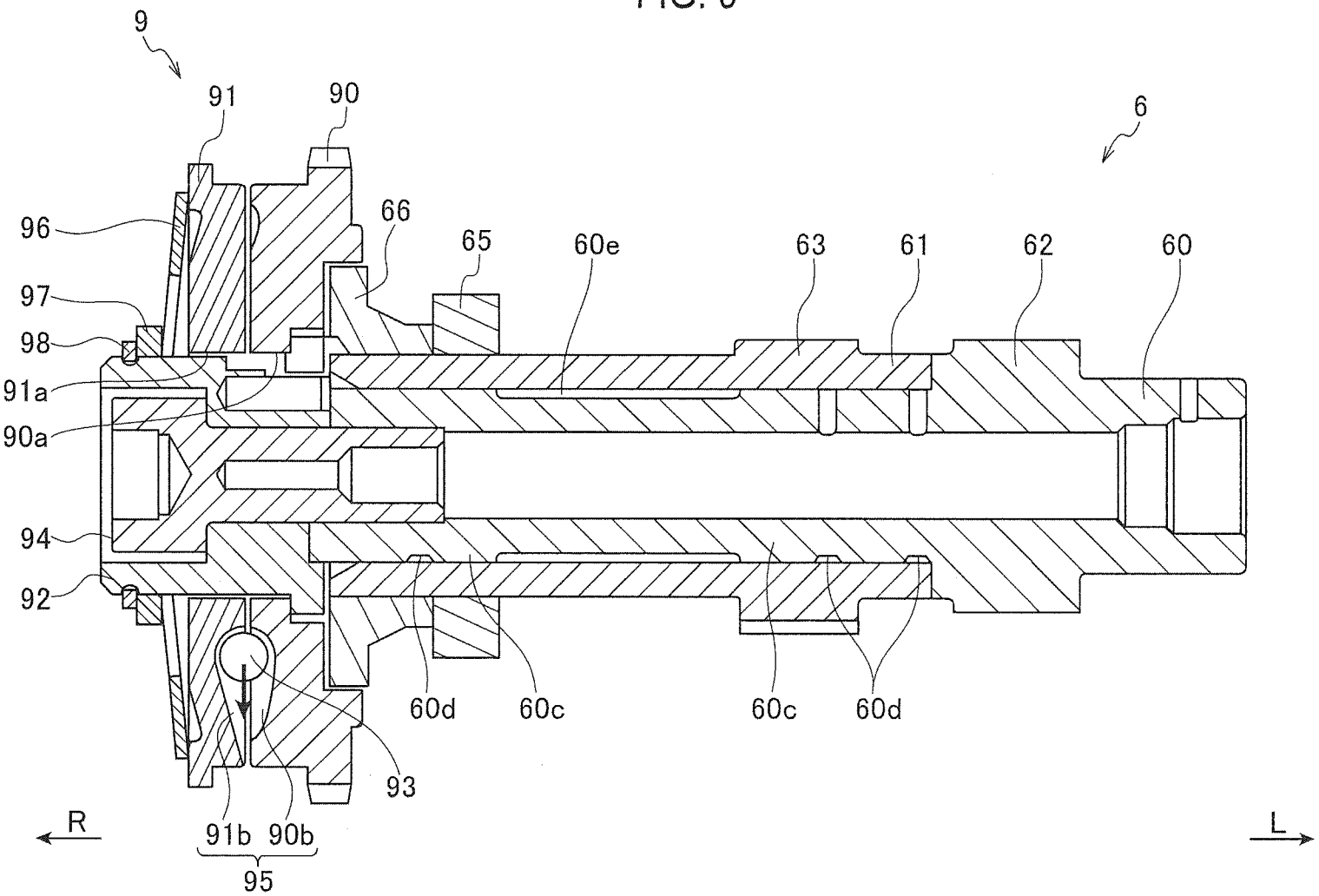
FIG. 9 is a cross-sectional view of the variable valve mechanism illustrated in FIG. 8.
Figure 10A:
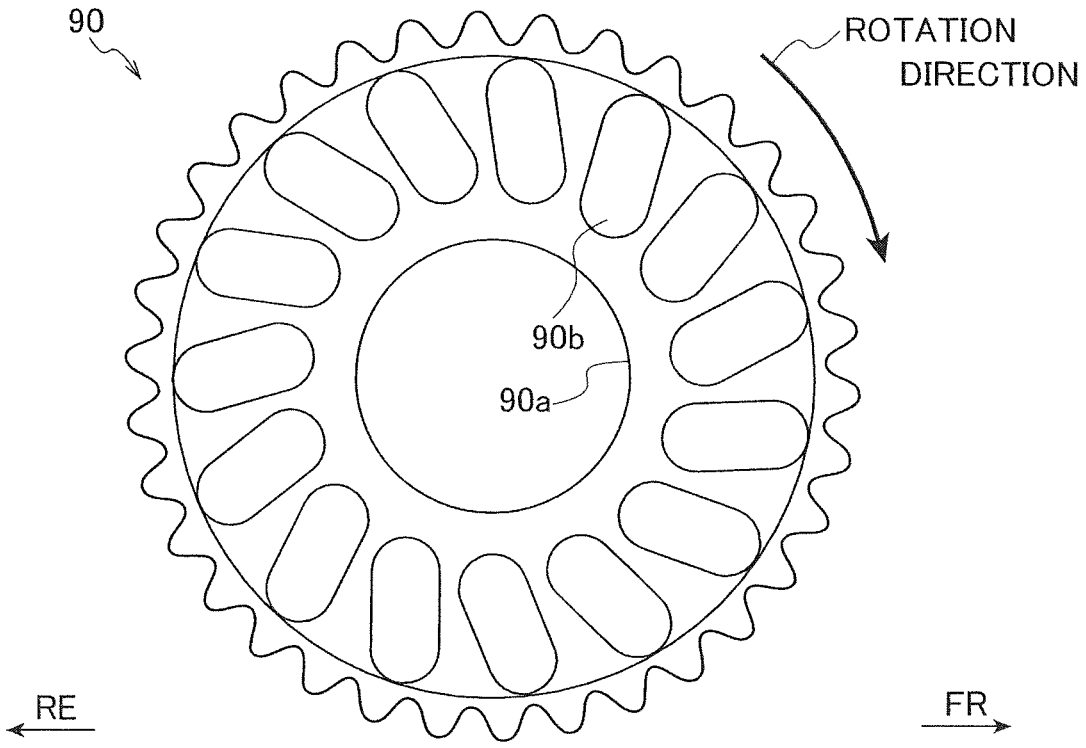
FIGS. 10A and 10B are diagrams illustrating a part of components of the variable valve mechanism according to the modified example.
Figure 10B:
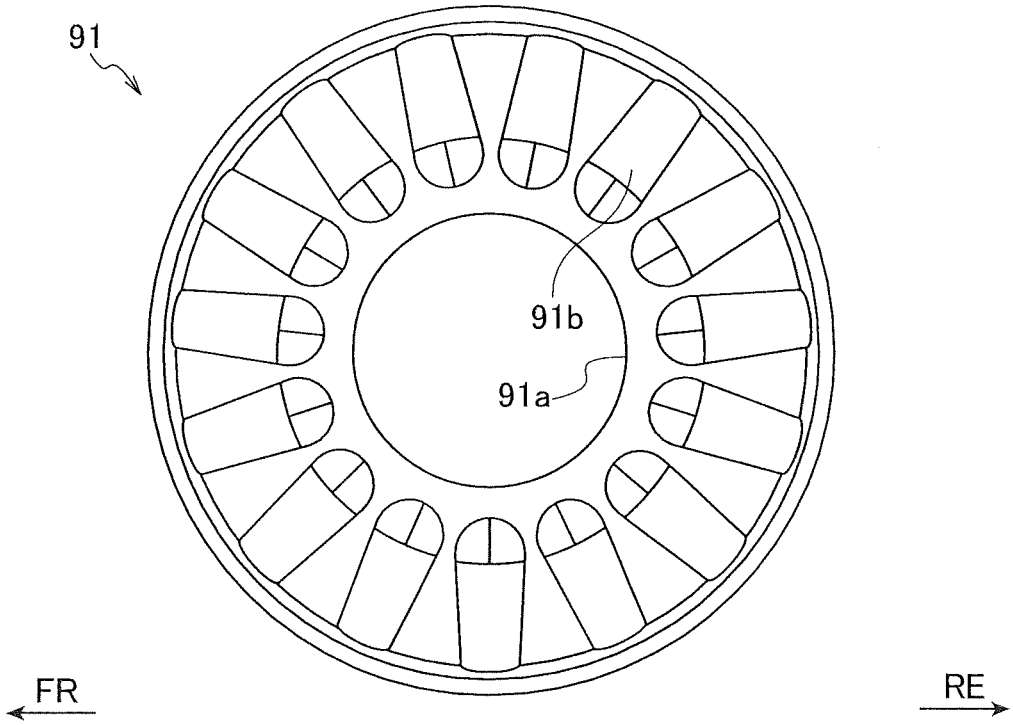

Next, a variable valve mechanism according to a modified example will be described with reference to FIGS. 8 to 10. FIG. 8 is a perspective view of the variable valve mechanism according to the modified example. FIG. 9 is a cross-sectional view of the variable valve mechanism illustrated in FIG. 8. FIGS. 10A and 10B are diagrams illustrating a part of the components of the variable valve mechanism according to the modified example. FIG. 10A is a diagram illustrating the cam sprocket when viewed from the right side and FIG. 10B is a diagram illustrating the circular plate when viewed from the left side. Further, in the modified example, since the configuration of the cam shaft assembly 6 (the cam shaft 6) is substantially the same as that of the embodiment, the same reference numeral will be given to the same component and a description thereof will be omitted.

As illustrated in FIGS. 8 to 10, the variable valve mechanism 9 according to the modified example has a configuration in which a circular plate 91 and a spline flange 92 are attached to a right surface of a cam sprocket 90 provided at a right end of the cam shaft 6. Although it will be described later in detail, the circular plate 91 and the spline flange 92 are rotatable by the centrifugal force generated by the rotation of the cam shaft 6.

The cam sprocket 90 is attached to the exhaust cam shaft 61 through the sprocket flange 66 to be rotatable together. The center of the cam sprocket 90 is provided with a circular hole 90*a*. Further, a plurality of spherical grooves 90*b* (fifteen spherical grooves in FIGS. 10A and 10B) are formed in a right surface of the cam sprocket 90 at the same interval in the circumferential direction. Specifically, the spherical groove 90*b* has an oval shape which is long in the radial direction in the side view. Further, the longitudinal direction of the spherical groove 90*b* is slightly inclined backward in the rotation direction relatively to the radial direction of the cam sprocket 90. Although it will be described later in detail, a left half portion of a ball 93 is received in each spherical groove 90*b*. Further, the number of the spherical grooves 90*b* is not limited to the above-described example and can be modified appropriately.

The circular plate 91 has substantially the same diameter as that of the cam sprocket 90 and the center thereof is provided with a circular hole 91*a*. The circular plate 91 is attached to face the right surface of the cam sprocket 90. A plurality of spherical grooves 91*b* (which are fifteen spherical grooves similarly to the spherical groove 90b) are formed in the side surface (the left surface) of the circular plate 91 facing the cam sprocket 90 at the same interval in the circumferential direction to correspond to the spherical grooves 90*b* of the cam sprocket 90. Specifically, the spherical groove 91*b* is formed in an oval shape to be long in the radial direction in the side view. Further, the longitudinal direction of the spherical groove 91*b* matches the radial direction of the cam sprocket 90. Although it will be described later in detail, a right half portion of the ball 93 is received in each spherical groove 91*b*.

A cylindrical spline flange 92 is attached to the circular hole 91*a* of the circular plate 91. A spline (not illustrated) is formed in the inner surface of the circular hole 91*a* and the outer surface of the spline flange 92. When the circular plate 91 and the spline flange 92 are spline-fitted to each other, the circular plate 91 and the spline flange 92 rotate together. When the bolt 94 is inserted through the center of the spline flange 92 and the bolt 94 is threaded into the screw hole 60*a* (see FIG. 5) of the intake cam shaft 60, the spline flange 92 is fixed to the intake cam shaft 60.

Additionally, the spline flange 92 is provided with an engagement pin (not illustrated). When the engagement pin engages with the engagement groove 60*b* (see FIG. 5) of the intake cam shaft 60, the circular plate 91 and the spline flange 92 rotate along with the intake cam shaft 60. The circular plate 91 and the spline flange 92 with this configuration serve as a transfer member that transmits the rotation of the cam sprocket 90 to the intake cam shaft 60.

The balls 93 are received in the spherical grooves 90*b* and 91*b* between the cam sprocket 90 and the circular plate 91. The ball 93 has a size in which the ball is slidable along the spherical grooves 90*b* and 91*b*. That is, the spherical grooves 90*b* and 91*b* constitute a guide groove 95 which guides the movement of the ball 93. Further, although it will be described later in detail, the ball 93 serves as an intermediate operation member capable of switching the relative rotation or the integral rotation between the cam sprocket 90 and the circular plate 91 (the spline flange 92) of the governor arm.

A spring washer 96, a ring spacer 97, and a C-ring 98 are sequentially attached to the right surface of the circular plate 91. Specifically, the spring washer 96 and the ring spacer 97 pass through the spline flange 92. Further, the C-ring 98 engages with the outer surface of the spline flange 92 to regulate the rightward movement of the ring spacer 97 and the spring washer 96 in the axial direction. The spring washer 96 has an urging force in the axial direction and urges the circular plate 91 leftward toward the cam sprocket 90. Accordingly, the balls 93 are sandwiched by the cam sprocket 90 and the circular plate 91.

In the variable valve mechanism 9 with this configuration, when the engine is not started or the engine rotation speed is a predetermined rotation speed or less as illustrated in FIG. 9, the ball 93 is located at the inside of the guide groove 95 in the radial direction. At this time, the cam sprocket 90 and the circular plate 91 (the spline flange 92) can rotate together without any relative rotation. Thus, in the valve train 5 (see FIG. 2), the opening and closing of the intake valve 50 and the exhaust valve 51 is controlled at a normal valve timing.

Meanwhile, when the engine rotation speed exceeds a predetermined rotation speed, the ball 93 moves outward in the radial direction along the guide groove 95 due to the centrifugal force of the ball 93. At this time, since the spherical groove 90*b* of the cam sprocket 90 is inclined backward in the rotation direction with respect to the radial direction, the circular plate 91 rotates backward in accordance with the movement of the ball 93. That is, the circular plate 91 (the spline flange 92) rotates relatively to the cam sprocket 90. Accordingly, the intake cam shaft 60 rotates relatively to the cam sprocket 90 so that the opening/closing timing of the intake valve 50 is adjusted. In this way, in the variable valve mechanism 9 according to the modified example, the ball 93 (the intermediate operation member) moves outward in the radial direction along the guide groove 95 by the centrifugal force accompanied by the rotation of the cam sprocket 90. Accordingly, since the circular plate 91 (the transfer member) can be rotated relatively to the cam sprocket 90, the valve timing can be adjusted with a simple and easy configuration. With this configuration, even in the modified example, the valve timing can be adjusted by using the centrifugal force.

Additionally, the invention is not limited to the above-described embodiment and can be modified into various forms. In the above-described embodiment, the sizes or the shapes illustrated in the accompanying drawings are not limited thereto and can be appropriately changed without departing from the effect of the invention. In addition, an appropriately modification can be made without departing from the object of the invention.

For example, in the above-described embodiment, the single cylinder engine 2 has been exemplified, but the invention is not limited to this configuration. For example, the valve train 5 (the variable valve mechanisms 7 and 9) according to the embodiment may be also applied to a multi-cylinder engine.

Further, in the above-described embodiment, the single cylinder engine has a so-called four valve type valve train in which each of the intake valve 50 and the exhaust valve 51 is provided at two positions so that four valves are provided in total, but the invention is not limited to this configuration. The number of the intake valves 50 and the exhaust valves 51 can be appropriately changed.

Further, in the above-described embodiment, a configuration has been described in which one of engagement portions is formed as an engagement pin and the other thereof is formed as an engagement hole or a groove, but the invention is not limited to this configuration. For example, one of the engagement portions may be formed as an engagement hole or a groove and the other thereof may be formed as a protrusion such as an engagement pin.

Further, in the above-described embodiment, the variable valve mechanism 7 is used to adjust the opening/closing timing of the intake valve 50, but the invention is not limited to this configuration. The variable valve mechanism 7 may be used to adjust the opening/closing timing of the exhaust valve 51.

Further, in the above-described embodiment, a predetermined centrifugal force (an engine rotation speed) during the operation of the variable valve mechanism 7 (during the rotation of the governor arm 71) can be appropriately changed in response to a desired valve timing.

INDUSTRIAL APPLICABILITY

As described above, the invention has an effect that a simple and compact configuration can be realized and is particularly useful for a variable valve mechanism applicable to a single overhead camshaft (SOHC) type valve train, an engine, and an automatic two-wheeled vehicle.

REFERENCE SIGNS LIST

1 automatic two-wheeled vehicle
2 engine
5 valve train
50 intake valve
51 exhaust valve
53, 90 cam sprocket
6 cam shaft
60 intake cam shaft (first cam shaft)
61 exhaust cam shaft (second cam shaft)
62 intake cam (intake side cam)
63 exhaust cam (exhaust side cam)
7, 9 variable valve mechanism
70 governor flange (transfer member)

71 governor arm (intermediate operation member)
71*a* support portion
71*b* weight portion
71*c* engagement portion
91 circular plate (transfer member)
92 spline flange (transfer member)
93 ball (intermediate operation member)
95 guide groove

What is claimed is:

1. A variable valve mechanism which changes an opening/closing timing of an intake valve or an exhaust valve in response to an engine rotation speed, the variable valve mechanism comprising:

a cam sprocket which rotates in response to a rotation of a crank shaft;

a first cam shaft which is integrated with any one of intake side and exhaust side cams;

a second cam shaft which is integrated with the other cam; and a transfer member that transmits a rotation of the cam sprocket to the first and second cam shafts; and an intermediate operation member that is able to switch a relative rotation or an integral rotation of the cam sprocket and the transfer member, wherein the first and second cam shafts are formed so that the other cam shaft is inserted through one cam shaft to be relatively rotatable; and the transfer member is provided to rotate along with any one of the first and second cam shafts and rotates relatively to the cam sprocket under a predetermined condition; and the intermediate operation member engages with the cam sprocket and the transfer member and moves outward in the radial direction of the cam sprocket to rotate the transfer member relatively to the cam sprocket when the engine rotation speed exceeds a predetermined rotation speed.

2. The variable valve mechanism according to claim 1, wherein the transfer member rotates relatively to the cam sprocket when the engine rotation speed exceeds a predetermined rotation speed and rotates along with the cam sprocket when the engine rotation speed is a predetermined rotation speed or less.

3. The variable valve mechanism according to claim 1, wherein the intermediate operation member includes:

a support portion which is supported by the cam sprocket to be rotatable;

a weight portion which is formed to be separated from the support portion; and an engagement portion which engages with the transfer member; and the intermediate operation member rotates about the support portion as a support point, when the weight portion moves outward in the radial direction in accordance with the rotation of the cam sprocket.

4. The variable valve mechanism according to claim 1, wherein the intermediate operation member is formed to be slidable along a guide groove formed in the cam sprocket and the transfer member; and when the intermediate operation member moves outward in the radial direction in accordance with the rotation of the cam sprocket, the transfer member rotates relatively to the cam sprocket.

5. An engine comprising:

the variable valve mechanism according to claim 1.

6. An automatic two-wheeled vehicle comprising:

the engine according to claim 5.

* * * * *